US007785140B2

(12) United States Patent
Henry

(10) Patent No.: US 7,785,140 B2
(45) Date of Patent: Aug. 31, 2010

(54) MODULAR ELECTRICAL CONNECTOR WITH OPPOSING CONTACT SUPPORT MEMBERS

(75) Inventor: Randall R. Henry, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 164 days.

(21) Appl. No.: 12/211,695

(22) Filed: Sep. 16, 2008

(65) Prior Publication Data

US 2010/0068904 A1 Mar. 18, 2010

(51) Int. Cl.
*H01R 13/60* (2006.01)

(52) U.S. Cl. ..... 439/541.5; 439/59; 439/65; 439/607.25; 439/607.39; 439/906

(58) Field of Classification Search ..... 439/59, 439/65, 78, 80, 541.5, 607.23, 607.25, 607.35, 439/607.39, 607.4, 906
See application file for complete search history.

(56) References Cited

U.S. PATENT DOCUMENTS 4,808,115 A * 2/1989 Norton et al. ..... 439/79
4,887,353 A * 12/1989 Preputnick ..... 29/830
5,647,749 A 7/1997 Atoh et al.
6,045,389 A * 4/2000 Ferrill et al. ..... 439/398
6,328,601 B1 * 12/2001 Yip et al. ..... 439/607.08
6,629,858 B2 * 10/2003 Lo et al. ..... 439/607.56
6,780,054 B2 * 8/2004 Yip et al. ..... 439/607.27
7,413,468 B1 * 8/2008 Little et al. ..... 439/490
7,442,055 B2 * 10/2008 Robinette ..... 439/79
7,618,262 B2 * 11/2009 Fogg et al. ..... 439/65
7,670,170 B2 * 3/2010 Henry et al. ..... 439/490
2008/0305692 A1 * 12/2008 Little et al. ..... 439/676
2010/0068904 A1 * 3/2010 Henry ..... 439/81

* cited by examiner

*Primary Examiner*—James Harvey

(57) ABSTRACT

A contact sub-assembly is provided for an electrical connector. The contact sub-assembly includes a base configured for mounting to a mating component. The base includes a pair of opposite side surfaces. A pair of separate contact support members are mounted on the base. Each contact support member holds a separate set of electrical contacts. Each contact support member includes a mounting portion engaged with a corresponding one of the side surfaces of the base such that a portion of the base extends between the mounting portions of the contact support members. The sets of electrical contacts held by the contact support members cooperate to define a mating interface for a mating connector.

16 Claims, 6 Drawing Sheets

MODULAR ELECTRICAL CONNECTOR WITH OPPOSING CONTACT SUPPORT MEMBERS

BACKGROUND OF THE INVENTION

The subject matter described and/or illustrated herein relates generally to electrical connectors, and more particularly, to modular electrical connectors that mate with a plurality of plugs.

Various electronic systems, such as those used to transmit signals in the telecommunications industry, include a single electrical connector that includes a plurality of ports, or jacks, that each receives a different plug. Each port has a sub-assembly of electrical contacts (referred to herein as a contact sub-assembly) that mate with electrical contacts of the corresponding plug. For example, at least some known contact sub-assemblies include a plurality of electrical contacts terminated to a circuit board. Specifically, the electrical contacts extend between a mating portion that mates with the electrical contacts of the corresponding plug and a mounting portion that is electrically connected to the circuit board.

Due to continuing trends toward miniaturization, it is desirable to reduce the distance between adjacent ports of the electrical connector. Reducing the distance between adjacent ports will reduce a size of the electrical connector for a given number of ports or will enable the electrical connector to carry more ports for a given size. To reduce the distance between adjacent ports, two sets of electrical contacts of the same port are sometimes sandwiched on opposite sides of the corresponding circuit board. A single support member holds both sets of the electrical contacts on the circuit board by straddling an edge of the circuit board. However, it may be difficult and/or time consuming to install the support member and the electrical contacts on the circuit board. For example, it may sometimes be necessary to install the support member on the circuit board before inserting the electrical contacts into the support member, which may increase a difficulty and/or a time required to assembly the electrical connector.

There is a need for a contact sub-assembly for an electrical connector having electrical contacts that are more easily installed on opposite sides of a circuit board of the contact sub-assembly.

BRIEF DESCRIPTION OF THE INVENTION

In one embodiment, a contact sub-assembly is provided for an electrical connector. The contact sub-assembly includes a base configured for mounting to a mating component. The base includes a pair of opposite side surfaces. A pair of separate contact support members is mounted on the base. Each contact support member holds a separate set of electrical contacts. Each contact support member includes a mounting portion engaged with a corresponding one of the side surfaces of the base such that a portion of the base extends between the mounting portions of the contact support members. The sets of electrical contacts held by the contact support members cooperate to define a mating interface for a mating connector.

Optionally, a cover surrounds at least a portion of each of the contact support members. The cover optionally has a pair of opposed support walls separated by a gap, wherein the electrical contacts extends along at least a portion of the length of the support walls, and wherein a first of the sets of the electrical contacts held by a first of the contact support members is provided on one of the support walls and a second of the sets of the electrical contacts held by a second of the contact support members is provided on the other of the support walls.

Optionally, the base includes a via and at least one of the electrical contacts includes a mounting end portion that is at least partially received within the via. At least one of the electrical contacts optionally includes a mounting end portion that is electrically connected to the base. At least one of the electrical contacts optionally includes a mounting end portion that includes a compliant pin.

In another embodiment, an electrical connector is provided for mating with a mating connector. The electrical connector includes a housing having a cavity configured to receive the mating connector, and a contact sub-assembly held by the housing.

In another embodiment, an electrical connector is provided for mating with a mating connector. The electrical connector includes a housing having a cavity configured to receive the mating connector, and a contact sub-assembly held by the housing. The contact sub-assembly is received within the cavity for mating with the mating connector. The contact sub-assembly includes a base having a pair of opposite side surfaces, and a pair of separate contact support members mounted on the base. Each contact support member holds a separate set of electrical contacts. The sets of electrical contacts held by the contact support members cooperate to define a mating interface for the mating connector. Each contact support member includes a mounting portion engaged with a corresponding one of the side surfaces of the base such that a portion of the base extends between the mounting portions of the contact support members.

DETAILED DESCRIPTION OF THE INVENTION

Figure 1:
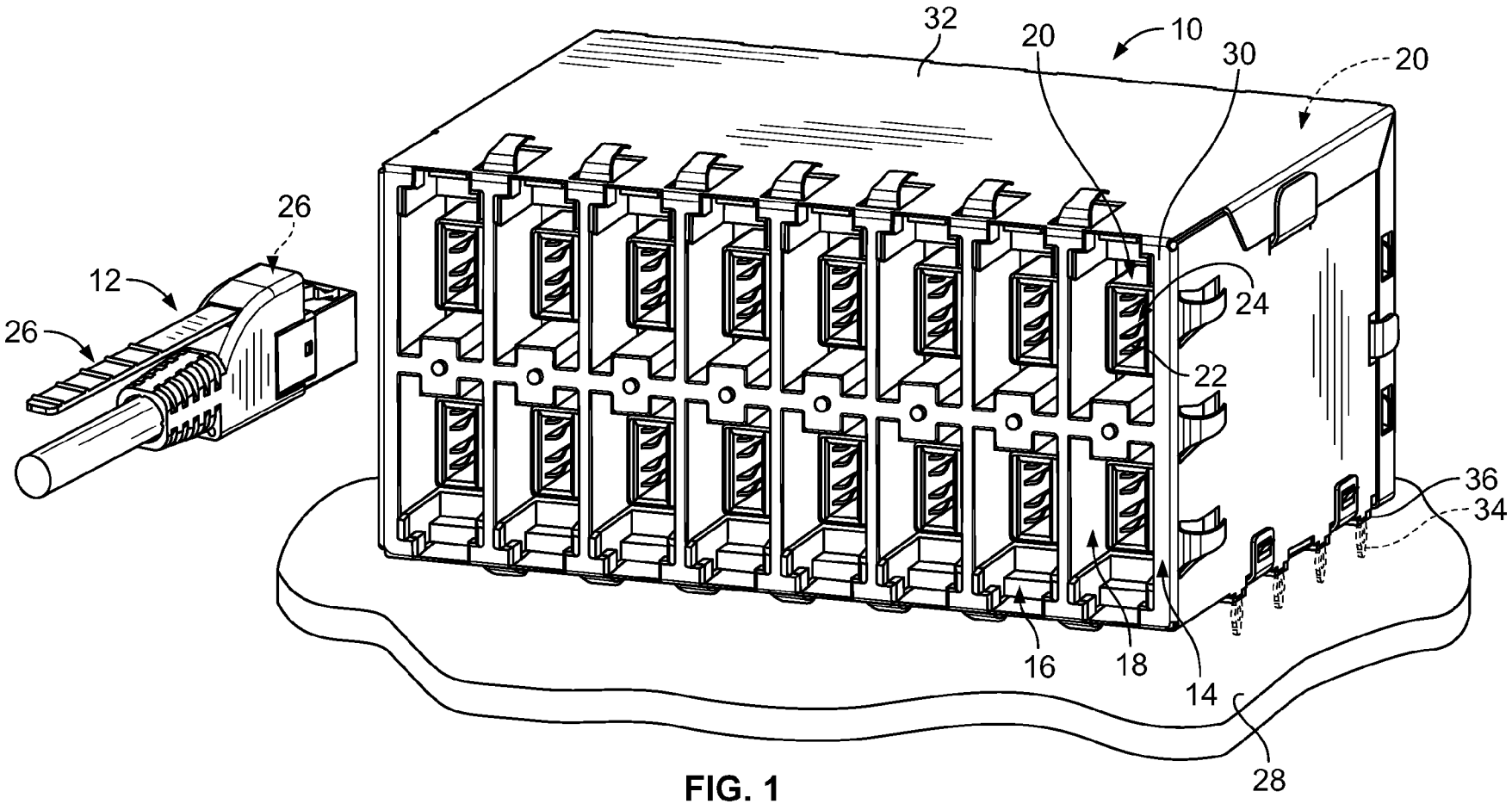
FIG. 1 is a perspective view of an exemplary embodiment of an electrical connector.

FIG. 1 is a perspective view of an exemplary embodiment of an electrical connector 10. In the exemplary embodiment, the electrical connector 10 is a receptacle connector that receives a mating connector 12, which is represented by the plug connector shown in FIG. 1. The electrical connector 10 and the mating connector 12 are modular connectors, such as, but not limited to, the types of electrical connectors used for connecting telecommunications equipment, computer networking equipment, and/or the like. In the exemplary embodiment of FIGS. 1-7, the electrical connector 10 and the mating connector 12 are eight pin, eight conductor (8P8C) modular connectors having signal pairs. However the subject matter described herein also has applicability to other connectors having fewer and/or greater numbers of pins, conductors and/or signal pairs.

The electrical connector 10 includes a housing 14 having multiple ports 16 opening to cavities 18. Each of the ports 16 is configured to receive a mating connector 12 therethrough. The housing 14 holds a plurality of contact sub-assemblies 20. The contact sub-assemblies 20 are each held within a corresponding one of the cavities 18 for mating with a mating connector 12 through the corresponding port 16. Each of the contact sub-assemblies 20 includes a plurality of electrical contacts 22 arranged along a mating interface 24 for mating with mating contacts (not shown) of the mating connector 12. The electrical contacts 22 and the mating contacts of the mating connector 12 are arranged in similar patterns for mating engagement. Optionally, the electrical contacts 22 are arranged, or grouped, as differential signal pairs. In the exemplary embodiment, the mating connector 12 includes an optional latch 26 for securing the mating connector 12 within the cavity 18.

The housing 14 is mounted to a substrate 28. In the exemplary embodiment, the substrate 28 is a circuit board. However, the substrate 28 is not limited to circuit boards, but rather may be any other suitable substrate 28. The electrical connector 10 is optionally mechanically and electrically connected to the circuit board for sending and receiving signals. In some embodiments, a plurality of the electrical connectors 10 may be mounted to the substrate 28. The substrate 28 and the electrical connector(s) 10 may be mounted within an electrical device and/or apparatus having a communications port through which the device may communicate with other externally networked devices. Alternatively, the electrical connector 10 may be wall mounted or panel mounted for connection with the mating connectors 12. In some embodiments, the electrical connector 10 may include only a single cavity 18 and corresponding contact sub-assembly 20 for mating with a single mating connector 12. Additionally, in some embodiments, rather than sending and receiving the signals via a circuit board, the electrical connector 10, or more particularly, the contact sub-assemblies 20, may be terminated to an end of a cable (not shown).

In the exemplary embodiment, the housing 14 includes a dielectric body 30 that defines the cavities 18. A cover 32 at least partially surrounds the body 30 and the contact sub-assemblies 20. Optionally, the cover 32 is electrically conductive and defines a shield, such as, but not limited to, an electromagnetic interference (EMI) shield. The cover 32 includes optional mounting tabs 34 for mounting to the substrate 28. The mounting tabs 34 may mechanically and/or electrically connect to the substrate 28 in any suitable manner, such as, but not limited to, the compliant pin type shown in the exemplary embodiment. Specifically, in the exemplary embodiment the mounting tabs 34 are compliant pins that are received within vias 36 of the substrate for mechanically and electrically connecting the cover 32 to the substrate 28.

Figure 2:
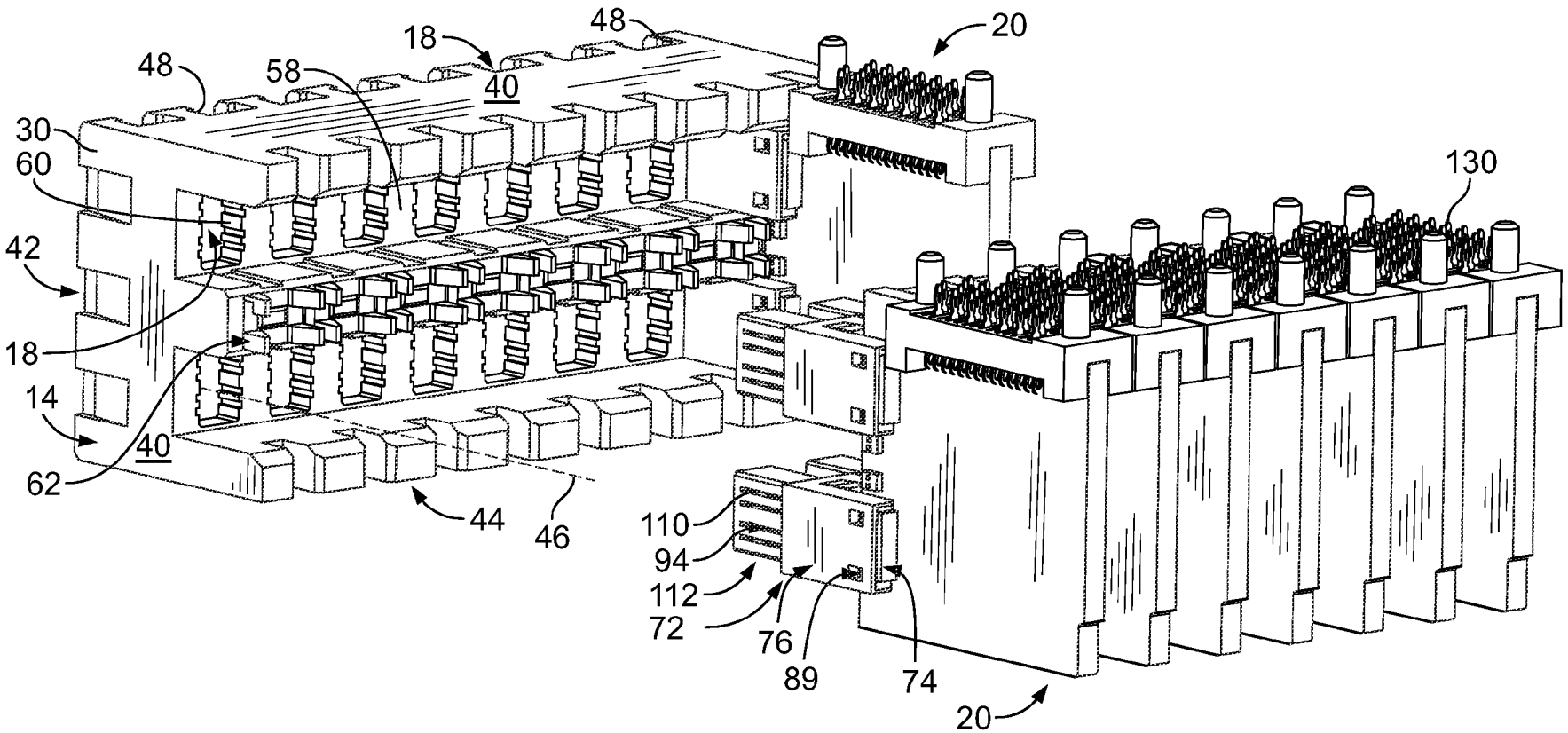
FIG. 2 is a partially exploded perspective view of an exemplary embodiment of a housing and an exemplary embodiment of a plurality of contact sub-assemblies of the electrical connector shown in FIG. 1.

FIG. 2 is a partially exploded perspective view illustrating the housing 14 holding the contact sub-assemblies 20. The housing body 30 includes outer walls 40 that define a perimeter of the housing body 30. The outer walls 40 extend between a mating end portion 42 and a terminating end portion 44 of the housing body 30. The cavities 18 are open at the mating end portion 42 for receiving the mating connectors 12 (FIG. 1), and each extend along a cavity axis 46 at least partially between the mating end portion 42 and the terminating end portion 44. Optionally, the mating connector 12 may be loaded into the cavity 18 in a direction substantially parallel to the cavity axis 46. In the exemplary embodiment, the cavities 18 are arranged in two rows and six columns, however, fewer and/or greater rows and/or columns of cavities 18 may be provided in alternative embodiments.

The cavities 18 are defined by inner walls 48 of the housing body 30. In the exemplary embodiment, and as best seen in FIG. 1, the inner walls 48 define a cavity 18 having a rectangular cross-section. However, the cavities 18 may each have any other suitable shape(s) that enable the cavities 18 to function as described and/or illustrated herein. The inner walls 48 also define a bottom wall 58 along the terminating end portion 44. An opening 60 extends through the bottom wall 58. As will be described below, a portion of the contact sub-assembly 20 extends through the opening 60 into the cavity 18.

In some embodiments, the housing 14 holds one or more light pipes 62, and/or any other suitable type of indicator(s) (such as, but not limited to, light emitting diodes (LED's)), associated with corresponding ones of the cavities 18 for identifying a connectivity and/or operational state of the contact sub-assembly 20 associated therewith.

The contact sub-assemblies 20 generally include the electrical contacts 22 and a sub-structure for supporting or holding the electrical contacts for mating engagement with the mating connector 12 and/or for terminating, or otherwise interconnecting, the electrical contacts with a mating component, such as the substrate 28 (FIG. 1) or individual wires of a cable (not shown). Exemplary contact sub-assemblies 20 are illustrated in FIG. 2, and are described in further detail in FIG. 3.

Figure 3:
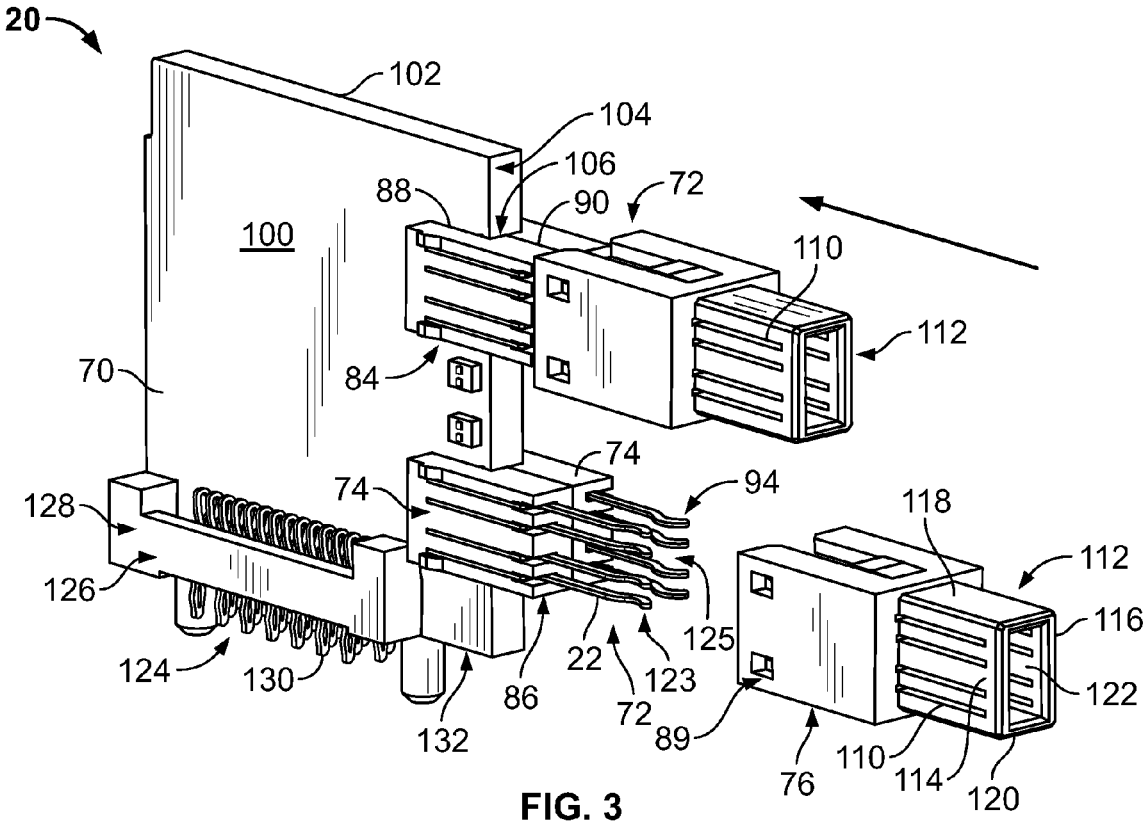
FIG. 3 is a partially exploded perspective view of a contact sub-assembly shown in FIG. 2.

FIG. 3 is a partially exploded perspective view of the contact sub-assembly 20. The contact sub-assembly 20 includes a base 70 and a pair of contact support assemblies 72 mounted on the base 70. In the exemplary embodiment, the base 70 is a circuit board and the electrical contacts 22 are electrically connected to the circuit board, as will be described below. However, in alternative embodiments, such as, but not limited to, an embodiment wherein the contact sub-assembly 20 is terminated directly to a cable (not shown), the base 70 may be a different component, such as, but not limited to, a housing component (not shown) that is used to mount to the end of the cable. For example, the base 70 may be formed as part of, or may be used in conjunction with, the housing body 30 (FIG. 2) and may be mounted to the end of the cable.

Both contact support assemblies 72 are mounted on the base 70 and are arranged in a stacked configuration. Each contact support assembly 72 includes a pair of separate contact support members 74 and a cover 76. Each contact support assembly 72 supports a group of the electrical contacts 22 that is used for interfacing with a different mating connector 12 (FIG. 1). Additionally, each contact support assembly 72 and the corresponding set of electrical contacts 22 are received within a different cavity 18 (FIGS. 1 and 2) of the housing 14 (FIG. 2) for interfacing with the corresponding mating connector 12. While two contact support assemblies 72 are shown mounted on the base 70, the base 70 may hold any number of contact support assemblies 72. For example, the number of contact support assemblies 72 held by the base 70 may depend on the number of cavities 18 arranged in one of the columns of cavities of the housing 14. Similarly, the housing 14 may only include a single row of cavities 18, or possibly only a single cavity 18, in which case, the contact sub-assembly 20 may only include a single contact support assembly 72.

Figure 4:
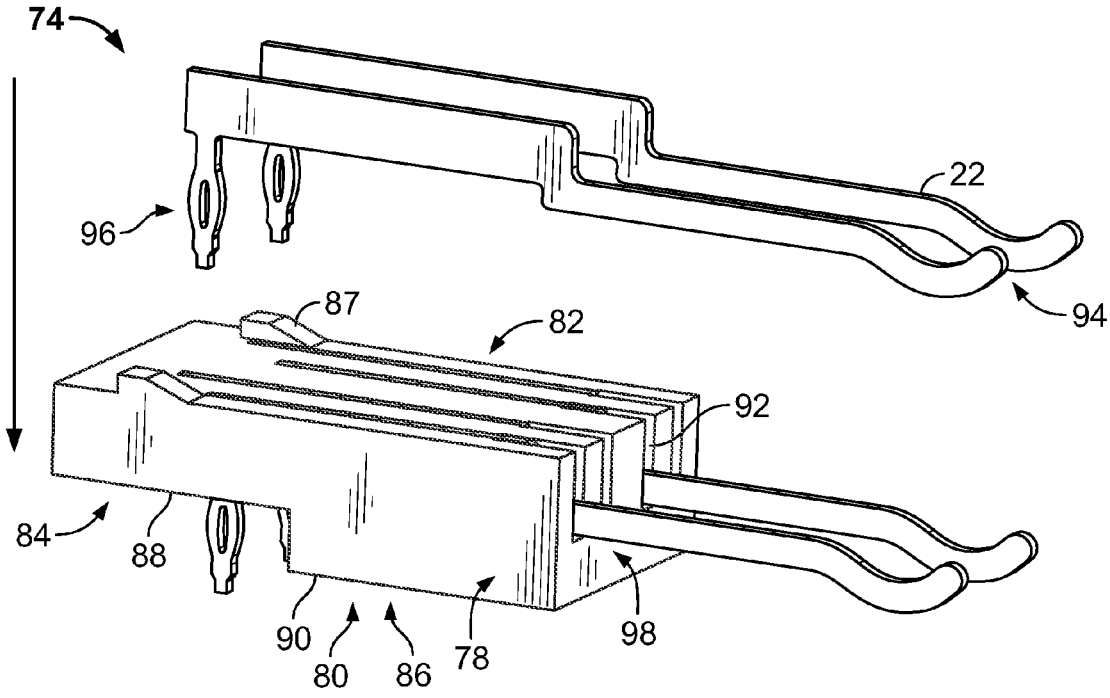
FIG. 4 is a partially exploded perspective view of a contact support member of the contact sub-assembly shown in FIG. 3.
Figure 5:
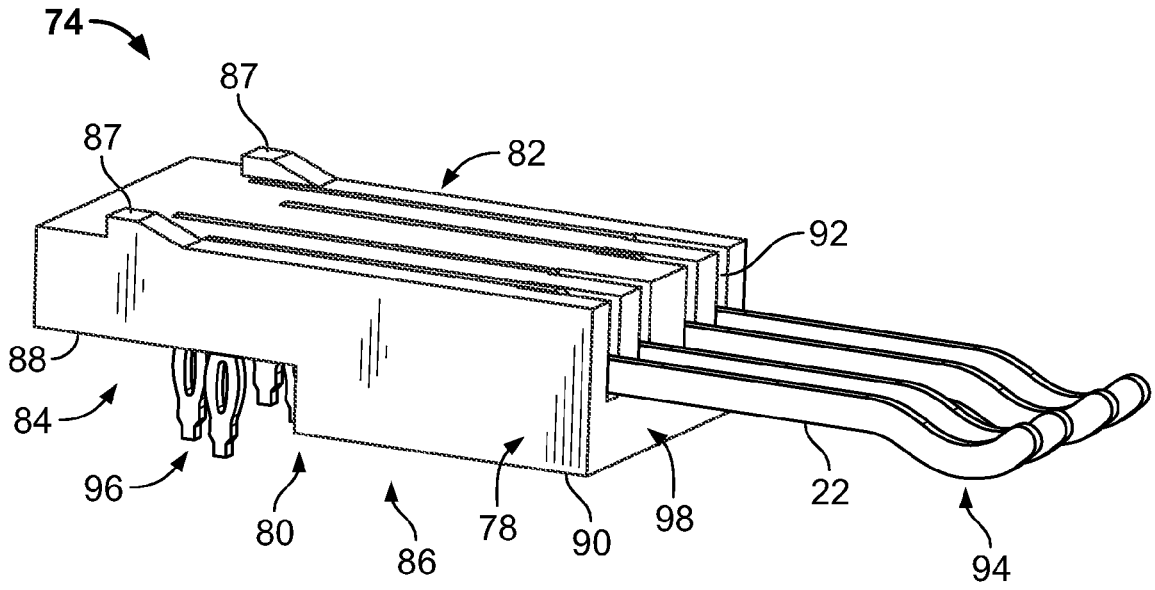
FIG. 5 is a perspective view of the contact support member shown in FIG. 4.

Referring now to FIGS. 4 and 5, each contact support member 74 includes a body 78 having an inner side portion 80 and an opposite outer side portion 82. The body 78 also includes a mounting portion 84 and an engagement portion 86. A portion of the inner side portion 80 is defined by the mounting portion 84 while the other portion of the inner side portion 80 is defined by the engagement portion 86. Similarly, a portion of the outer side portion 82 is defined by the mounting portion 84 while the other portion of the outer side portion 82 is defined by the engagement portion 86. The outer side portion 82 is configured for engagement with the cover 76 (FIG. 3), as will be described below. The outer side portion 82 optionally includes a latch element 87 for cooperation, as described below, with a latch element of the cover 76 (such as, but not limited to, the latch element 89 of the cover 76). Although shown as a pair of extensions 87 that are each received within a corresponding opening 89 of the cover 76, the latch elements 87 may be any suitable type of latch element for cooperating with any suitable type of latch element of the cover 76. Moreover, the contact support member 74 may include any number of latch elements 87 for cooperation with any number of latch elements of the cover 76.

As will be described below, the mounting portion 84 is configured to be mounted on the base 70 (FIG. 3). Specifically, the mounting portion 84 includes a mounting surface 88 that extends along the inner side portion 80 and is configured to engage the base 70. The engagement portion 86 is configured to engage the engagement portion 86 of the opposite contact support member 74 of the same contact support assembly 72. Specifically, the engagement portion 86 includes an engagement surface 90 that engages the engagement surface 90 of the opposite contact support member 74, as described below.

The body 78 of the contact support member 74 holds a plurality of the electrical contacts 22. Specifically, the body 78 includes a plurality of slots 92. Each slot 88 holds a corresponding one of the electrical contacts 22. Each electrical contact 22 extends between a mating end portion 94 that is configured to mate with the mating contacts of the mating connector 12 (FIG. 1), and a mounting end portion 96 that is configured to engage the base 70 as described below. Along the engagement portion 86, each slot 92 extends only partially through the body 78. Along the mounting portion 84, each slot 92 extends completely through the body 78. Each electrical contact 22 is held within the corresponding slot 92 such that the mounting end portion 96 is exposed along the mounting portion 84 and the inner side portion 80 such that the mounting end portion 96 extends outwardly from the mounting surface 88. The mating end portion 94 of each electrical contact 22 extends outwardly from an edge portion 98 of the engagement portion 86 of the body 78. In the exemplary embodiment, the electrical contacts 22 are optionally arranged as differential pairs. Specifically, and as best seen in FIG. 5, the electrical contacts 22 are arranged as a differential pair 100 and a differential pair 102.

Figure 6:
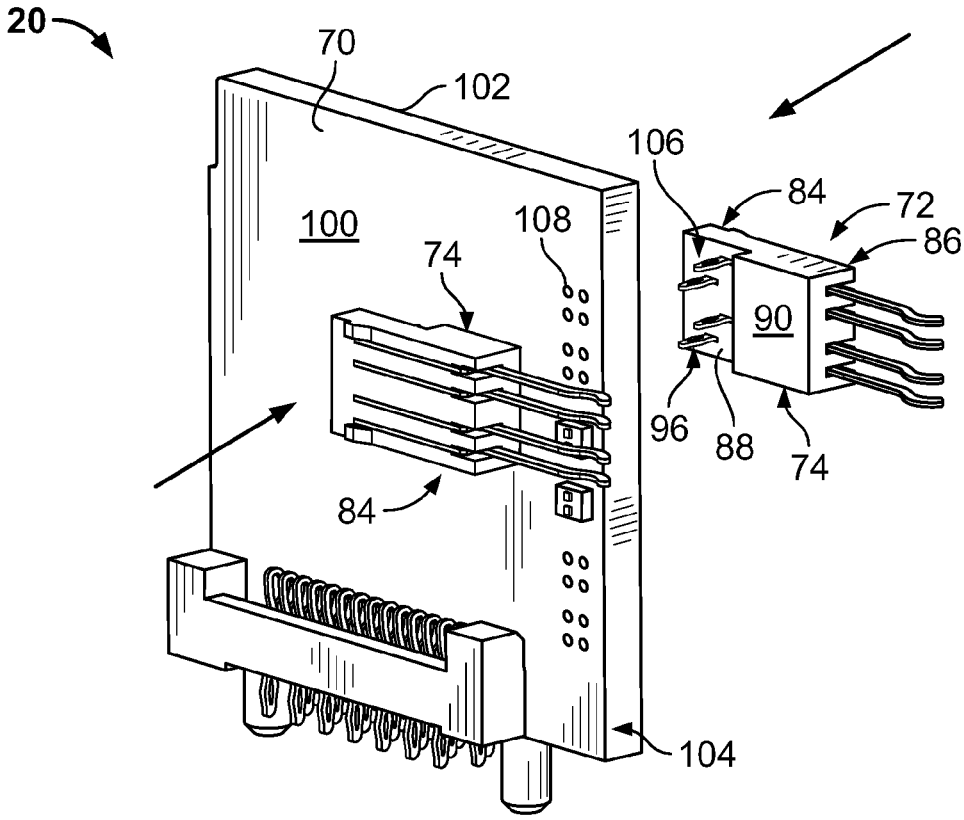
FIG. 6 is a partially exploded perspective view of a portion of the contact sub-assembly shown in FIG. 3.

Referring now to FIGS. 3 and 6, the base 70 includes a pair of opposite side surfaces 100 and 102, and an edge portion 104 that intersects the side surfaces 100 and 102. For each contact support assembly 72, each of the pair of contact support members 74 is mounted on a corresponding one of the side surfaces 100 and 102 such that a portion of the base 70 extends between the contact support members 74. Specifically, the mounting portions 84 of the contact support members 74 are engaged with the corresponding side surfaces 100 and 102 such that the mounting surfaces 88 are engaged with the corresponding side surfaces 100 and 102 and such that the engagement surfaces 90 are engaged with each other. The contact support members 74 thereby define an approximately U-shaped opening 106 between the mounting portions 84 that receives a portion of the base 70 therein, as is best seen in FIG. 3. When the contact support members 74 of a single contact support assembly 72 are mounted on the base 70 as shown in FIG. 3, the engagement portions 86, and thereby the engaged engagement surfaces 90, extend outwardly from the edge portion 104 of the base 70. Similarly, the mating end portions 94 of the electrical contacts 22 extend outwardly from the edge portion 104 of the base 70.

In the exemplary embodiment, and as best seen in FIG. 6, the mounting end portions 96 of the electrical contacts 22 are electrically connected to the base 70. Specifically, in the exemplary embodiment the mounting end portions 96 of the electrical contacts 22 are compliant pins that are each received within a corresponding electrically conducive via 108 of the base 70. Alternatively, the mounting end portions 96 of each of the electrical contacts 22 may be electrically connected to the base 70 using any other suitable type of electrical connection, such as, but not limited to, being electrically and mechanically connected to the vias 108 by soldering, being electrically connected to an electrically conductive surface element (such as, but not limited to, a pad), and/or the like. In the exemplary embodiment, the electrical contacts 22 and the corresponding contact support member 74 can be mounted on the base 70 simultaneously, or the contact support member 74 may be first mounted to the base 70, and the corresponding electrical contacts 22 thereafter installed within the contact support member 74 and engaged with the base 70.

Referring now to FIGS. 2 and 3, for each contact support assembly 72, the cover 76 is coupled to the pair of contact support members 74 and supports the mating end portions 94 of the corresponding electrical contacts 22. Optionally, the electrical contacts 22 may be received within slots 110 extending along the cover 76. In the exemplary embodiment, a portion of the cover 76 surrounds the pair of contact support members 74, however, the cover 76 may alternatively be coupled to an end portion of the contact support members 74 such that at least a portion of the contact support members 74 are not surrounded by the cover 76. In the exemplary embodiment, the contact support members 74 and the cover 76 cooperate to support an entire length of the electrical contacts 22 (e.g. as measured from the mating end portion 94 to the mounting end portion 96). Alternatively, portions of the electrical contacts 22 may remain unsupported, such as an interior portion or an end portion of the electrical contacts 22.

As described above, the cover 76 includes the latch elements 89 for cooperation with latch elements of the contact support members 74 (such as, but not limited to, the latch elements 87). Although shown as openings 89 that receive a corresponding extension 87 of the contact support members 74, the latch elements 89 may be any suitable type of latch element for cooperating with any suitable type of latch element of the contact support members 74. Moreover, the cover 76 may include any number of latch elements 89 for cooperation with any number of latch elements of the contact support members 74.

Referring now to FIG. 3, the cover 76 of each of the contact support assemblies 72 includes a mating portion 112. The mating portion 112 is received within the cavity 18 (FIGS. 1 and 2) and interfaces with the mating connector 12 (FIG. 1). The mating portion 112 includes opposed support walls 114 and 116 and end walls 118 and 120 extending between the support walls 114 and 116. The mating portion 112 defines a gap 122 between the support walls 114 and 116 and between the end walls 118 and 120. The gap 122 defines a space sized and shaped to accept a portion of the mating connector 12 therein. Additionally, the electrical contacts 22 extend along the support walls 114 and 116 such that the electrical contacts 22 face, and are exposed to, the gap 122. In the exemplary embodiment, a set 123 of the electrical contacts 22 extends along the support wall 114 and a set 125 of the electrical contacts 22 extends along the other support wall 116. The electrical contacts 22 mate with the mating contacts of the mating connector 12 (FIG. 1) within the gap 122.

The contact sub-assembly 20 includes a mounting interface 124 that is mounted to a mounting component, such as, but not limited to, the substrate 28 (FIG. 1). The mounting component may be a cable or other component and/or device in alternative embodiments. In the exemplary embodiment, a header assembly 126 is provided at the mounting interface 124. The header assembly 126 includes a header body 128 having a plurality of mounting contacts 130 therein. The header body 128 and the mounting contacts 130 are mounted to the substrate 28. The header body 128 is coupled to the base 70 such that the mounted contacts are mechanically and electrically connected to pads (not shown) along an edge portion 132 of the base 70. Optionally, the edge portion 132 may be substantially perpendicular to the edge portion 104. Alternatively, the edge portion 132 may have a non-perpendicular orientation with respect to the edge portion 104, such as, but not limited to, a parallel and opposed orientation. The electrical contacts 22 are electrically connected to the mounting contacts 130 by the base 70, such as, but not limited to, by electrically conductive traces (not shown) of the base 70.

Referring now to FIG. 2, the contact sub-assemblies 20 are mounted to the housing body 30. In the exemplary embodiment, the contact sub-assemblies 20 are held by the housing body 30 using an interference fit. Alternatively, the contact sub-assemblies 20 may be attached to the housing body 30 using any suitable alternative securing method, structure, and/or means, such as, but not limited to, using a latch element (not shown) and/or the like. When assembled, the mating portions 112 of the contact support assemblies 72 are received within corresponding ones of the openings 60. Once assembled, the housing body 30 and the contact sub-assemblies 20 may be mounted to the substrate 28 (FIG. 1) as a unit. The mounting contacts 130 may be each aligned with a corresponding hole (not shown) in the substrate 28 and mounted thereto.

Figure 7:
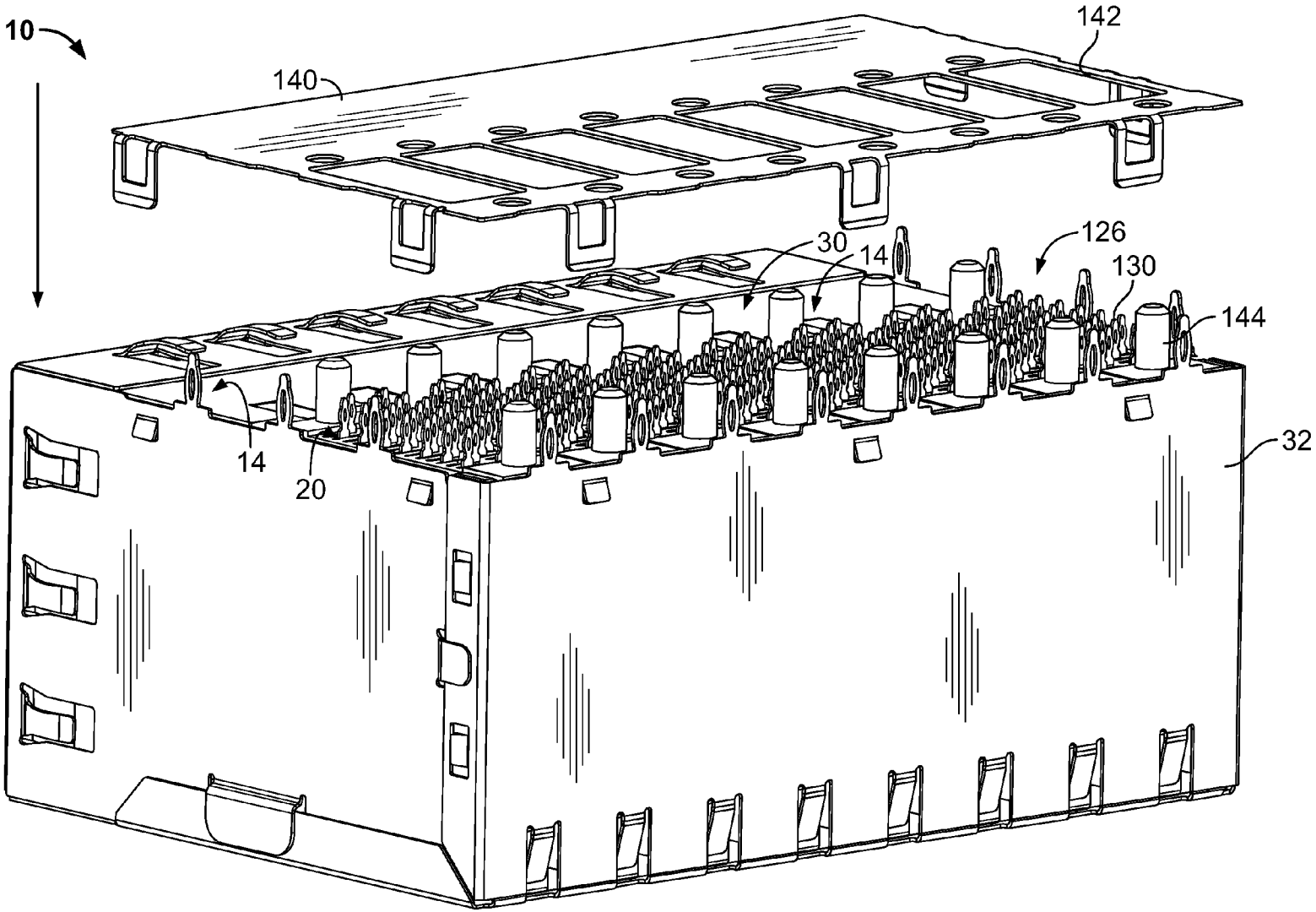
FIG. 7 is a perspective view of the housing and the contact sub-assemblies shown in FIG. 2.

FIG. 7 is a perspective view of the housing body 30 and the contact sub-assemblies 20. A bottom plate 140 forms part of the housing 14 and is secured to the cover 32. The bottom plate 140 cooperates with the cover 32 to surround the housing body 30 and the contact sub-assemblies 20. The bottom plate 140 provides shielding, such as, but not limited to, EMI shielding. Openings 142 are provided in the bottom plate 140 that receive the mounting contacts 130 and mounting lugs 144 of the header assembly 126 for mounting to the substrate 28.

Figure 8:
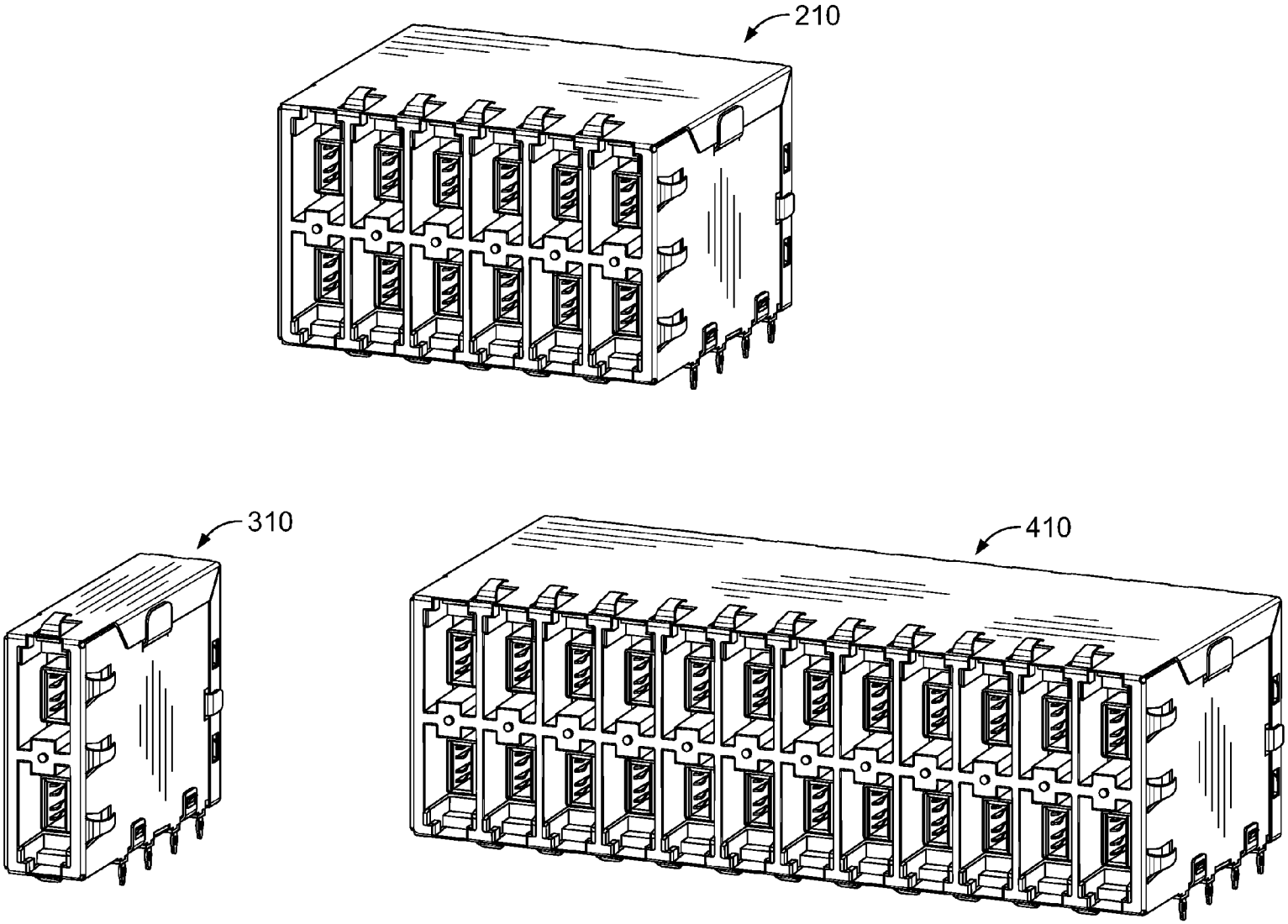
FIG. 8 illustrates a plurality of non-limiting alternative embodiments of electrical connectors.

Although the electrical connector 10 is shown herein as having sixteen cavities 18 and eight contact sub-assemblies 20 for mating with sixteen mating connectors 12, the electrical connector 10 may have any suitable number of cavities 18 and/or contact sub-assemblies 20 for mating with any number of mating connectors 12. For example, FIG. 8 illustrates a plurality of non-limiting alternative embodiments of electrical connectors 210, 310, and 410 configured to mate with different numbers of mating connectors 12 (FIG. 1).

The embodiments described and/or illustrated herein provide a contact sub-assembly for an electrical connector having electrical contacts that may be more easily installed on opposite sides of a circuit board of the contact sub-assembly.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and/or illustrated has been described in terms of various specific embodiments, those skilled in the art will recognize that the subject matter described and/or illustrated can be practiced with modification within the spirit and scope of the claims.

What is claimed is:

1. A contact sub-assembly for an electrical connector, said contact sub-assembly comprising:

a base configured for mounting to a mating component, the base comprising a pair of opposite side surfaces;

a pair of separate contact support members mounted on the base, each of the contact support members holding a separate set of electrical contacts, wherein each of the contact support members comprises a mounting portion engaged with a corresponding one of the side surfaces of the base such that a portion of the base extends between the mounting portions of the contact support members, the sets of electrical contacts held by the contact support members cooperating to define a mating interface for a mating connector; and a cover surrounding at least a portion of each of the contact support members, the cover having a pair of opposed support walls separated by a gap, the electrical contacts extending along at least a portion of the length of the support walls, wherein a first of the sets of the electrical contacts held by a first of the contact support members is provided on one of the support walls and a second of the sets of the electrical contacts held by a second of the contact support members is provided on the other of the support walls, the electrical contacts being exposed to the gap for engagement with the mating connector.

2. The contact sub-assembly according to claim 1, wherein the contact support members define an opening between the mounting portions, a portion of the base being received within the opening.

3. The contact sub-assembly according to claim 1, wherein each of the contact support members comprises an engagement surface, the engagement surfaces of the contact support members being engaged together.

4. An electrical connector for mating with a mating connector, said electrical connector comprising:

a housing having a cavity configured to receive the mating connector; and a contact sub-assembly held by the housing, the contact sub-assembly being received within the cavity for mating with the mating connector, the contact sub-assembly comprising:

a base comprising a pair of opposite side surfaces;

a pair of separate contact support members mounted on the base, each of the contact support members holding a separate set of electrical contacts, the sets of electrical contacts held by the contact support members cooperating to define a mating interface for the mating connector, wherein each of the contact support members comprises a mounting portion engaged with a corresponding one of the side surfaces of the base such that a portion of the base extends between the mounting portions of the contact support members; and a cover surrounding at least a portion of each of the contact support members, the cover having a pair of opposed support walls separated by a gap, the electrical contacts extending along at least a portion of the length of the support walls, wherein a first of the sets of the electrical contacts held by a first of the contact support members is provided on one of the support walls and a second of the sets of the electrical contacts held by a second of the contact support members is provided on the other of the support walls, the electrical contacts being exposed to the gap for engagement with the mating connector.

5. The electrical connector according to claim 4, wherein at least one of the electrical contacts comprises a mounting end portion engaged with the base, the mounting end portion comprising a compliant pin.

6. The contact sub-assembly according to claim 1, wherein the base comprises an edge portion that intersects the side surfaces, each of the contact support members comprising an engagement surface, the engagement surfaces being engaged together and extending outwardly beyond the edge portion of the base.

7. The contact sub-assembly according to claim 1, wherein the base comprises an edge portion that intersects the side surfaces, the electrical contacts being held by the contact support members such that the electrical contacts extend outwardly beyond the edge portion of the base.

8. The contact sub-assembly according to claim 1, wherein the base comprises a via, at least one of the electrical contacts comprising a mounting end portion that is at least partially received within the via.

9. The contact sub-assembly according to claim 1, wherein at least one of the electrical contacts comprises a mounting end portion that is electrically connected to the base.

10. The contact sub-assembly according to claim 1, wherein at least one of the electrical contacts comprises a mounting end portion engaged with the base, the mounting end portion comprising a compliant pin.

11. The contact sub-assembly according to claim 1, wherein the electrical contacts are arranged as differential pairs.

12. The contact sub-assembly according to claim 1, wherein the base comprises a circuit board.

13. The electrical connector according to claim 4, wherein the base comprises a via, at least one of the electrical contacts comprising a mounting end portion that is at least partially received within the via.

14. The electrical connector according to claim 4, wherein the contact support members define an opening between the mounting portions, a portion of the base being received within the opening.

15. The electrical connector according to claim 4, wherein each of the contact support members comprises an engagement surface, the engagement surfaces of the contact support members being engaged together.

16. The electrical connector according to claim 4, wherein at least one of the electrical contacts comprises a mounting end portion that is electrically connected to the base.

* * * * *